US008437670B2

(12) United States Patent
Katagiri et al.

(10) Patent No.: US 8,437,670 B2
(45) Date of Patent: May 7, 2013

(54) IMAGE FORMING APPARATUS

(75) Inventors: Shinji Katagiri, Yokohama (JP); Masaru Shimura, Yokohama (JP); Ken Nakagawa, Yokohama (JP); Takamitsu Soda, Mishima (JP); Takaaki Akamatsu, Suntou-gun (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 13/009,063

(22) Filed: Jan. 19, 2011

(65) Prior Publication Data

US 2011/0188902 A1 Aug. 4, 2011

(30) Foreign Application Priority Data

Jan. 29, 2010 (JP) ..... 2010-018603

(51) Int. Cl.
*G03G 15/20* (2006.01)

(52) U.S. Cl.
USPC ..... 399/310; 399/316

(58) Field of Classification Search ..... 399/66, 399/297–299, 302, 310, 314, 316
See application file for complete search history.

(56) References Cited

U.S. PATENT DOCUMENTS

| | | | | |
|---|---|---|---|---|
| 5,697,033 | A | 12/1997 | Ichikawa et al. | |
| 5,915,145 | A | 6/1999 | Shimura et al. | |
| 6,711,367 | B2 | 3/2004 | Saito et al. | |
| 7,308,219 | B2 | 12/2007 | Shishido | |
| 7,546,074 | B2 * | 6/2009 | Oyama et al. | 399/302 |
| 7,570,908 | B2 * | 8/2009 | Fukuyama et al. | 399/302 |
| 7,835,678 | B2 | 11/2010 | Yasumaru et al. | |
| 7,917,074 | B2 | 3/2011 | Takada | |
| 2006/0083536 | A1 | 4/2006 | Shishido | |
| 2008/0253813 | A1 | 10/2008 | Inaba et al. | |
| 2009/0074485 | A1 | 3/2009 | Takada | |
| 2009/0202281 | A1 | 8/2009 | Doda et al. | |
| 2010/0158586 | A1 | 6/2010 | Yasumaru et al. | |

FOREIGN PATENT DOCUMENTS

| | | | |
|---|---|---|---|
| CN | 1763654 | A | 4/2006 |
| CN | 101387851 | A | 3/2009 |
| JP | 9-120218 | A | 5/1997 |

OTHER PUBLICATIONS

Notification of the First Office Action dated Feb. 8, 2013, in Chinese Application No. 201110034972.9.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member for bearing a toner image; an endless rotatable intermediary transfer belt onto which the toner image is to be transferred from the image bearing member; a transfer device disposed at a position in which the transfer device opposes the image bearing member through the intermediary transfer belt, the transfer device including a sheet member surface-contacted to an inner surface of the intermediary transfer belt and including an urging member for urging the sheet member toward the intermediary transfer belt; and a primary transfer voltage source for applying a voltage to the sheet member.

14 Claims, 7 Drawing Sheets

| | INITIAL | | AFTER 10,000 SHEETS | |
|---|---|---|---|---|
| | VERTICAL STRIPE | TRANSFER SCATTERING | VERTICAL STRIPE | TRANSFER SCATTERING |
| EMB.1 | ○ | ○ | ○ | ○ |
| COMP. EMB.1 | ○ | × | ○ | × |
| COMP. EMB.2 | × | ○ | × | ○ |
| COMP. EMB.3 | × | × | × | × |

FIG.4

| | INITIAL | | AFTER 10,000 SHEETS | | AFTER 50,000 SHEETS | |
|---|---|---|---|---|---|---|
| | VERTICAL STRIPE | TRANSFER SCATTERING | VERTICAL STRIPE | TRANSFER SCATTERING | VERTICAL STRIPE | TRANSFER SCATTERING |
| EMB.1 | ○ | ○ | ○ | ○ | △ | ○ |
| EMB.2 | ○ | ○ | ○ | ○ | ○ | ○ |

FIG.7

IMAGE FORMING APPARATUS

FIELD OF THE INVENTION AND RELATED ART

The present invention relates to an image forming apparatus, of an electrophotographic recording type, such as a laser printer or a copying machine.

In a conventional image forming apparatus, there is a transfer step in which a toner image carried on a surface of a photosensitive drum is electrostatically transferred onto a surface of a rotatable intermediary transfer belt or a surface of a transfer material carried on a conveyer belt by applying an electric field of an opposite polarity to a toner charge polarity by a transfer device.

To the transfer device, a voltage necessary for the transfer step is applied. As an example, there is a transfer roller, as the transfer device connected to a high voltage source, disposed at a position in which the transfer portion opposes the photosensitive drum through a belt such as the intermediary transfer belt or the conveyer belt. However, in the case where the transfer roller is used, a transfer nip which is a contact area between the belt and the transfer roller becomes non-uniform with respect to a longitudinal direction which his belt width direction perpendicular to a rotational direction of the belt by the influence of bending of the transfer roller. When the transfer nip is non-uniform with respect to the longitudinal direction, a current necessary for the transfer step becomes non-uniform with respect to the longitudinal direction in the transfer nip to cause improper transfer (image defect) in some cases.

For that reason, as the transfer device, in place of the transfer roller, a constitution using a film has been proposed in Japanese Laid-Open Patent Application (JP-A) Hei 09-120218. In the constitution of JP-A Hei 09-120218, the film can be displaced between a film supporting member and the photosensitive drum and is moved toward and away from the transfer material depending on the presence or absence of an electrostatic attraction force due to supply or non-supply of the voltage, respectively.

However, in the constitution of JP-A Hei 09-120218, there is no urging member for urging the film itself toward the belt and therefore the improper transfer can be caused due to a surface state or resistance non-uniformity of the film. Specifically, there is the case where uniformity of contact between the film and the belt with respect to the longitudinal direction cannot be maintained when the film is moved toward and away from the belt only the electrostatic attraction force of the film and thus the transfer nip becomes non-uniform. At a portion where an area of the transfer nip between the film and the belt is narrow or is not formed, sufficient transfer current cannot be ensured, so that the transfer current flows into a wide transfer nip area in a large amount. For that reason, at the portion where the transfer nip area is narrow or is not formed, insufficient transfer current can occur to cause a vertical stripe-like transfer defect. Particularly, this phenomenon is liable to occur in a system in which the film is attracted to the belt only by the electrostatic attraction force. When the insufficient transfer current occurs, the electrostatic attractive force becomes weak, so that a non-uniform state of the transfer nip with respect to the longitudinal direction is further accelerated.

SUMMARY OF THE INVENTION

A principal object of the present invention is to satisfactorily perform transfer with a simple constitution or a conveyer belt to each other with respect to a longitudinal direction.

According to an aspect of the present invention, there is provided an image forming apparatus comprising:

an image bearing member for bearing a toner image;

an endless rotatable intermediary transfer belt onto which the toner image is to be transferred from the image bearing member;

a transfer device disposed at a position in which the transfer device opposes the image bearing member through the intermediary transfer belt, the transfer device including a sheet member surface-contacted to an inner surface of the intermediary transfer belt and including an urging member for urging the sheet member toward the intermediary transfer belt; and a primary transfer voltage source for applying a voltage to the sheet member, wherein with respect a rotational direction of the intermediary transfer belt, an upstream end portion of a contact area formed between the intermediary transfer belt and the sheet member and an upstream end portion of a contact area formed between the sheet member and the urging member are within a range of a contact area formed between the intermediary transfer belt and the image bearing member, and wherein the upstream end portion of the contact area formed between the intermediary transfer belt and the sheet member is located upstream of the upstream end portion of the contact area formed between the sheet member and the urging member.

These and other objects, features and advantages of the present invention will become more apparent upon a consideration of the following description of the preferred embodiments of the present invention taken in conjunction with the accompanying drawings.

Figure 2:
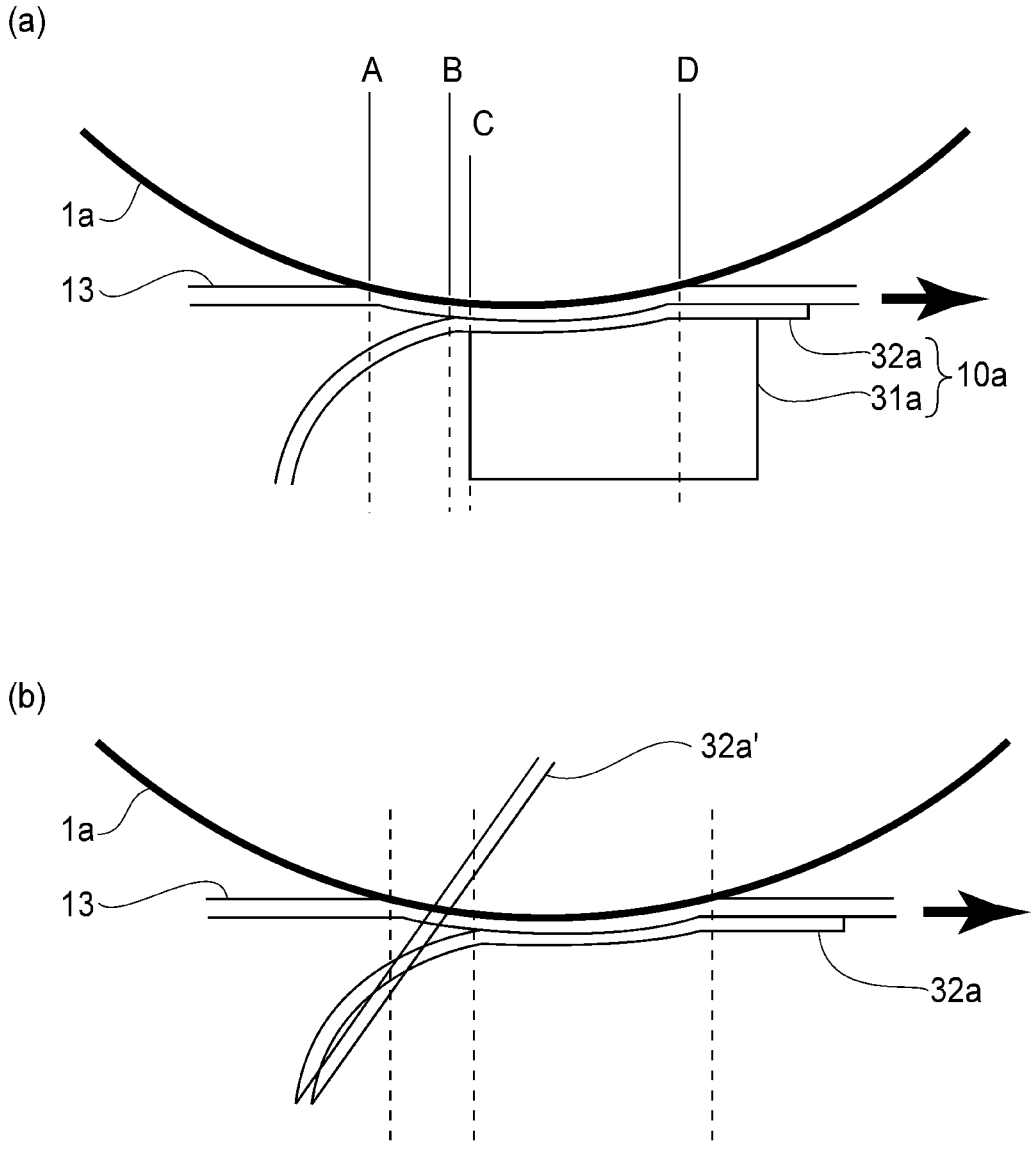

Parts (a) and (b) of FIG. 2 are schematic illustrations of a primary transfer device in Embodiment 1.

Figure 3:
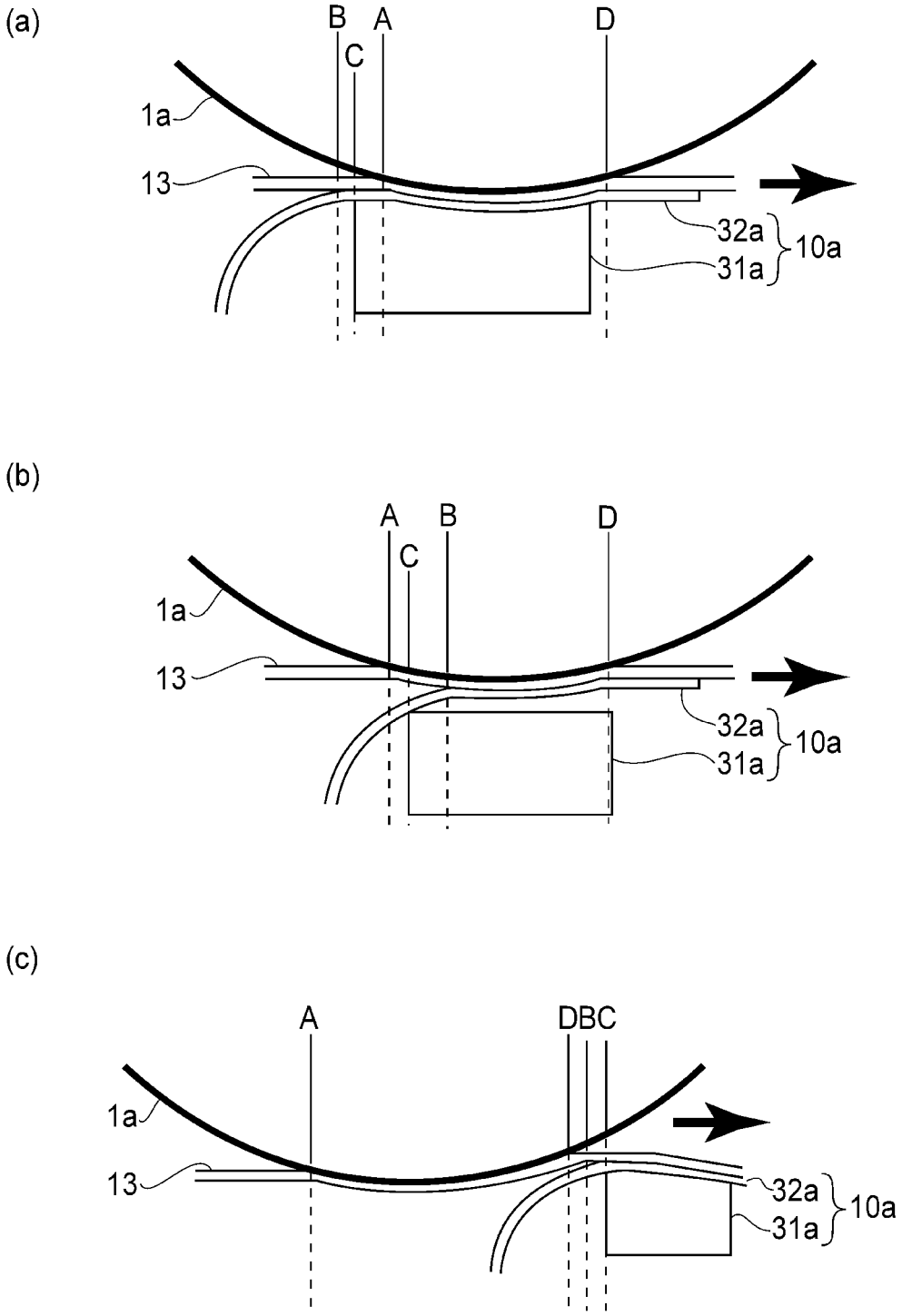

Parts (a) to (c) of FIG. 3 are schematic illustrations of primary transfer devices in Comparative Embodiments 1 to 3, respectively.

FIG. 4 is a table showing an evaluation result in Embodiment 1.

Figure 5:
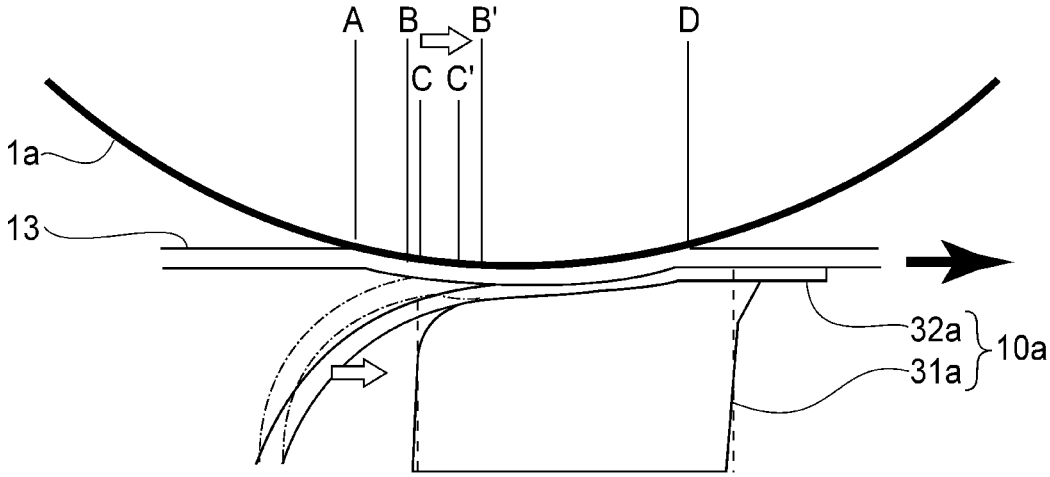

FIG. 5 is a schematic illustration showing a problem of the primary transfer device in Embodiment 1.

Figure 6:
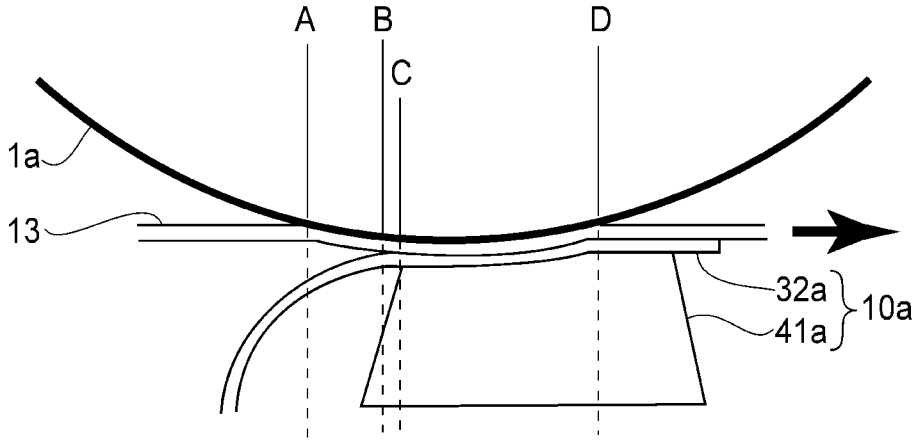

FIG. 6 is a schematic illustration of a primary transfer device in Embodiment 2.

FIG. 7 is a table showing an evaluation result in Embodiment 2.

Figure 8:
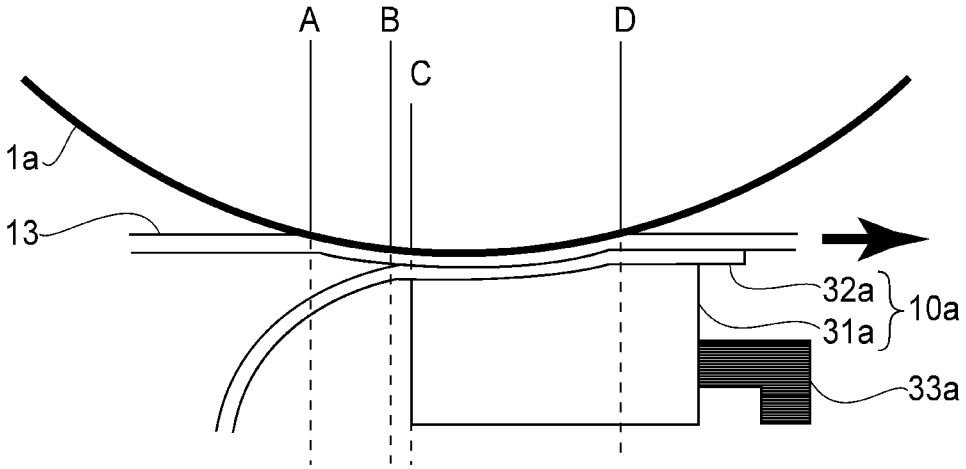

FIG. 8 is a schematic illustration of another primary transfer device in Embodiment 2.

Figure 9:
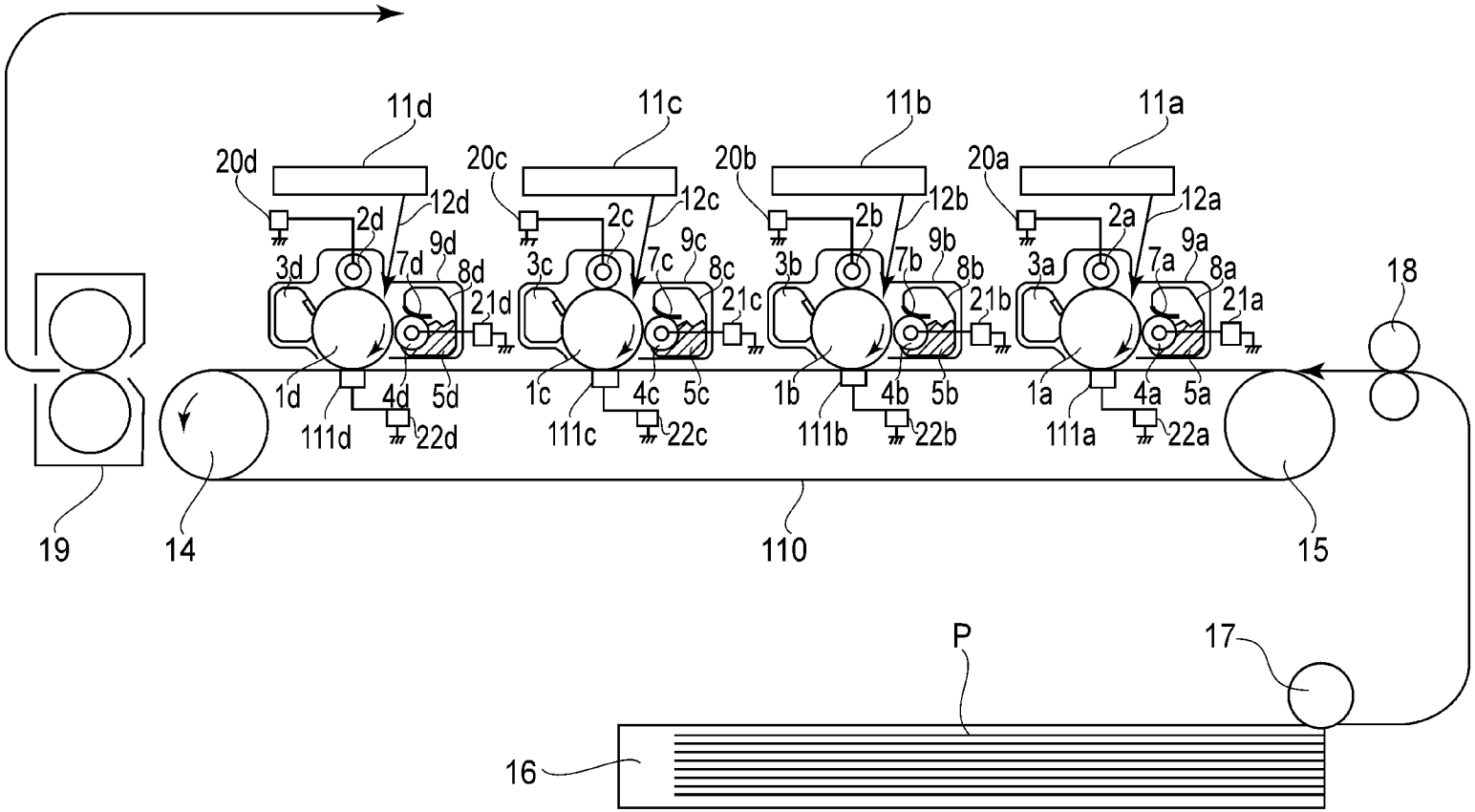

FIG. 9 is a schematic illustration an image forming apparatus according to another embodiment.

Figure 10:
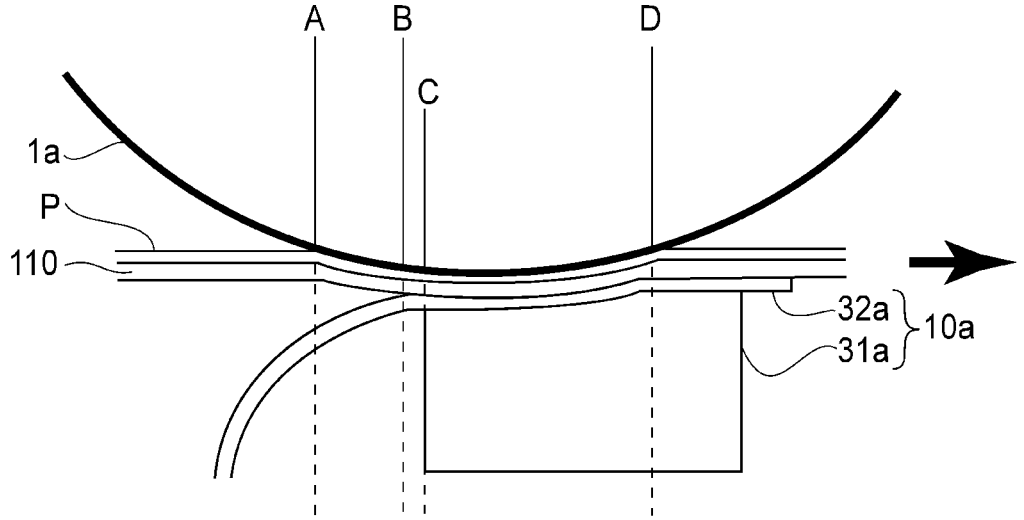

FIG. 10 is a schematic illustration of a primary transfer device in another embodiment.

DESCRIPTION OF THE PREFERRED EMBODIMENTS

Hereinbelow, embodiments for carrying out the present invention will be specifically described with reference to the drawings. However, with respect to dimensions, materials, shapes, relative arrangements and the like of constituent elements described in the following embodiments, the scope of the present invention is not limited thereto unless otherwise specified.

Embodiment 1

(Image Forming Apparatus)

Figure 1:
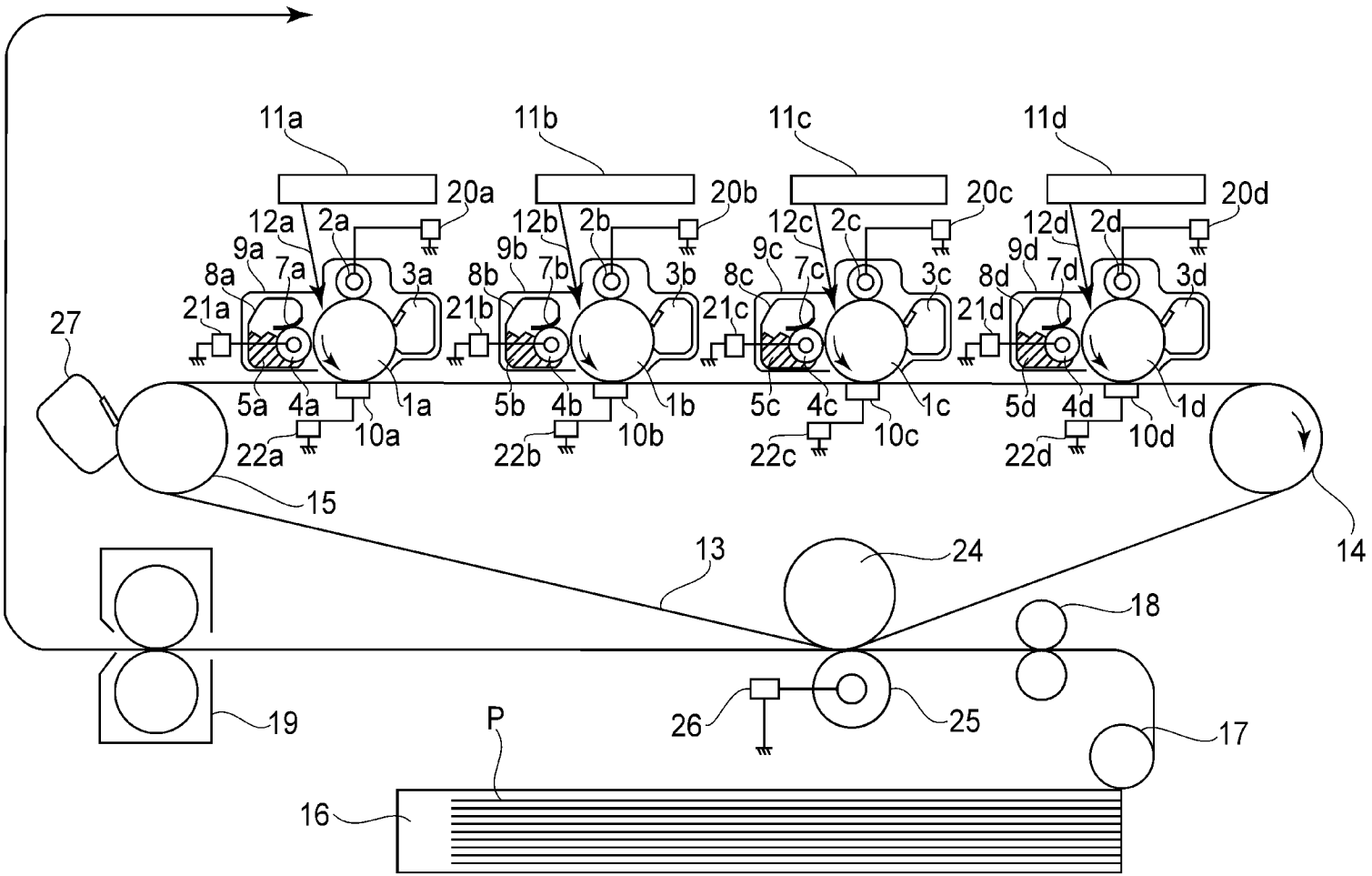
FIG. 1 is a schematic illustration of an image forming apparatus according to Embodiment 1.

With reference to FIG. 1, the image forming apparatus according to this embodiment will be described. In this embodiment, a first station is for yellow (Y), a second station is for magenta (M), a third station is for cyan (C), and a fourth station is for black (K).

The first station includes an OPC (organic photoconductor) photosensitive drum 1*a* as an image bearing member (hereinafter, simply referred to as a photosensitive drum). A charging roller 2*a*, a cleaning unit 3*a* and a developing unit 8*a* are disposed around the photosensitive drum 1*a*.

The charging roller 2*a* is connected to a charging bias voltage source 20*a* and uniformly charges the photosensitive drum 1*a* by being supplied with a voltage from the charging bias voltage source 20*a*.

The cleaning unit 3*a* removes transfer residual toner carried on the photosensitive drum 1*a*.

The developing unit 8*a* includes a developing sleeve 4*a*, a non-magnetic one component developer (hereinafter referred to as toner) 5*a* and a developer application blade 7*a*. The developing sleeve 4*a* is connected to a developing bias voltage source 21*a* and forms an image of the toner 5*a* on the photosensitive drum 1*a* by being supplied with a voltage from the developing bias voltage source 21*a*. These photosensitive drum 1*a*, charging roller 2*a*, cleaning unit 3*a* and developing unit 8*a* constitute an integral type process cartridge 9*a*.

An exposure device 11 is are constituted by a scanner unit for scanning the photosensitive drum 1*a* with laser light through a polygonal mirror and irradiates the surface of the photosensitive drum 1*a* with scanning beam 12*a* modulated on the basis of an image signal. In the above, the first station is described but other stations have the same constitution.

When an image forming operation is started, the photosensitive drums 1*a* to 1*d*, an intermediary transfer belt 13, and the like start their rotations in directions indicated by arrows at predetermined process speeds. The photosensitive drum 1*a* is uniformly charged to a negative polarity by the charging roller 2*a* connected to the charging bias voltage source 20*a* and then, on the photosensitive drum 1*a*, an electrostatic latent image in accordance with image information is formed by the scanning beam 12*a* from the exposure device 11. On the other hand, the toner 5*a* in the developing unit 8*a* is charged to the negative polarity by the developer application blade 7*a* and is applied onto the developing sleeve 4*a*.

Then, the photosensitive drum 1*a* is rotated and the electrostatic latent image formed on the photosensitive drum 1*a* reaches an opposing position in which the photosensitive drum 1*a* opposes the developing sleeve 4*a*. The toner 5*a* of the negative polarity applied on the developing sleeve 4*a* is subjected to the development of the electrostatic latent image on the surface of the photosensitive drum 1*a*. As a result, the electrostatic latent image is visualized by the toner 5*a*, so that a toner image of a first color (Y in this embodiment) is formed on the surface of the photosensitive drum 1*a*. Incidentally, also the second to fourth stations have the same constitution as and perform the same operation as those of the first station, so that toner images of respective colors are formed on the surfaces of the respective photosensitive drums 1*b* to 1*d*. As a result, on the photosensitive drums 1*a* to 1*d*, the toner images of respective colors are carried.

On the other hand, the intermediary transfer belt 13 which is an endless rotatable belt is disposed so as to be contacted to all the four photosensitive drums 1*a* to 1*d*. As the intermediary transfer belt 13, a 100 μm-thick member of PVDF (polyvinylidene fluoride) having a volume resistivity of $10^{10}$ Ω·cm is used. The intermediary transfer belt 13 is supported by three rollers, as a stretching member for the intermediary transfer belt 13, consisting of a secondary transfer opposite roller 24, a driving roller 14, and a tension roller 15, and is configured to be held under a proper tension. The intermediary transfer belt 13 is rotated in the same direction as that of the photosensitive drums 1*a* to 1*d* by driving the driving roller 14.

Further, inside the intermediary transfer belt 13, primary transfer devices 10*a* to 10*d* as the transfer device disposed opposed to the respective photosensitive drums 1*a* to 1*d* through the intermediary transfer belt 13 are provided. Each of portions (positions) where the photosensitive drums 1*a* to 1*d* and the primary transfer devices 10*a* to 10*d* oppose to each other through the intermediary transfer belt 13 is a primary transfer nip. The primary transfer devices 10*a* to 10*d* are connected to primary transfer voltage sources 22*a* to 22*d*, respectively.

The electrostatic latent image by the exposure is formed on each of the photosensitive drums 1*a* to 1*d* while delaying a writing signal from an unshown controller with certain timing for each color depending on a distance between adjacent primary transfer nips for the respective color toner images. The respective electrostatic latent images are developed into the respective toner images by using the developing units 8*a* to 8*d*. Then, to the primary transfer devices 10*a* to 10*d*, a voltage of an opposite polarity to the charge polarity of the toner images are applied by the primary transfer voltage sources 22*a* to 22*d*, respectively. As a result, in the respective primary transfer nips, the respective color toner images are transferred successively onto the intermediary transfer belt 13, so that multiplex toner images (multiplex images) are formed on the intermediary transfer belt 13. That is, in the respective primary transfer nips, the respective toner images carried by the respective photosensitive drums 1*a* to 1*d* are primary-transferred from the photosensitive drums 1*a* to 1*d* onto the intermediary transfer belt 13 and are carried on the surface of the intermediary transfer belt 13.

On the other hand, in synchronism with the formation of the electrostatic latent image by the exposure a transfer material P stacked in a transfer material cassette 16 is picked up by a sheet feeding roller 17. Incidentally, examples of the transfer material P may include recording materials such as paper, printing paper, a transfer material sheet, an OHP sheet and glossy paper. The fed transfer material P is conveyed to registration rollers 18 by unshown feeding rollers and is once stopped. Then, the transfer material P is conveyed to a secondary transfer nip formed between the intermediary transfer belt 13 and the secondary transfer roller 25 by the registration rollers 18 in synchronism with the multiplex toner images on the intermediary transfer belt 13.

Here, to the secondary transfer roller 25 connected to a secondary transfer voltage source 26, a voltage of an opposite polarity to the toner charge polarity of the multiplex toner images is applied from the secondary transfer voltage source 26. As a result, the multiplex four color toner images carried on the intermediary transfer belt 13 are collectively secondary-transferred onto the transfer material P and are carried on the surface of the transfer material P.

After the secondary transfer is completed, transfer residual toner remaining on the intermediary transfer belt 13 and paper powder generated by conveying the transfer material P are removed and collected from the surface of the intermediary transfer belt 13 by a belt cleaning device 27 disposed in contact with the intermediary transfer belt 13. Further, as the belt cleaning device 27 is a cleaning blade which is formed of an urethane rubber or the like and has elasticity. Further, the transfer material P, carrying thereon the multiplex toner images, after the completion of the secondary transfer is conveyed into a fixing device 19 and is subjected to fixation of the multiple toner images, thus being discharged to the outside of the image forming apparatus as an image-formed product (print or copy).

(Primary Transfer Device)

As shown in (a) of FIG. 2, the primary transfer device 10*a* includes an urging member 31*a* having elasticity and a flexible sheet member 32*a*. Widths of the urging member 31*a* and the sheet member 32*a* with respect to the longitudinal direction are equal to or wider than a width of the toner image to be primary-transferred. Incidentally, the longitudinal direction is a width direction of the intermediary transfer belt 13 perpendicular to a rotational direction of the intermediary transfer belt 13. The urging member 31*a* is uniformly urged toward the photosensitive drum 1*a* through the intermediary transfer belt 13 at a total pressure of 9.8 N with respect to the longitudinal direction by an unshown urging spring. The urging member 31*a* urges the sheet member 32*a* toward the intermediary transfer belt 13, so that the sheet member 32*a* surface-contacts the intermediary transfer belt 13 with reliability. As a result, the sheet member 32*a* is sandwiched and held between the intermediary transfer belt 13 and the urging member 31*a*. The sheet member 32*a* surface-contacts an inner surface of the intermediary transfer belt 13 at the same contact surface without being rotated relative to the urging member 31*a*.

Here, the sheet member 32*a* originally has a flat plate shape as indicated by a reference symbol 32*a*' in (b) of FIG. 2. Further, one end of the sheet member 32*a* on an upstream side with respect to the rotational direction of the intermediary transfer belt 13 (hereinafter, "with respect to the rotational direction of the intermediary transfer belt 13" will be omitted) is fixed in a state in which it is spaced from the intermediary transfer belt 13. The sheet member 32*a* is contactable to the intermediary transfer belt 13 by being bent so as to curve toward the intermediary transfer belt 13 from the fixed one end, spaced from the intermediary transfer belt 13, to the other end on a free end side. The sheet member 32*a* surface-contacts the intermediary transfer belt 13 until the free end on a downstream side. Further, even in the case where the urging member 31*a* is removed as shown in (b) of FIG. 2, the sheet member 32*a* keeps the contact state with the intermediary transfer belt 13 by a repelling force for returning its shape to the flat plate shape in the bent state by its rigidity. As a result, the urging member 31*a* contacts the sheet member 32*a* in the area in which the sheet member 32*a* contacts the intermediary transfer belt 13 at a surface opposite from the contact surface of the sheet member 32*a* with the intermediary transfer belt 13. Therefore, boundary positions B and C described later can be determined. Further, sheet member 32*a* has electroconductivity. To the sheet member 32*a*, the primary transfer voltage source 22*a* is connected, and a voltage of 500 V is applied during an image forming operation. Incidentally, also with respect to other primary transfer devices 10*b* to 10*d*, the same constitution is employed.

The urging member 31*a* is pressed by forming a foamed urethane sponge-like elastic member, which is an insulation member, into a substantially rectangular parallelepiped of 2 mm in thickness, 4 mm in width and 230 mm in length. The urging member 31*a* has a hardness of 30 degrees in terms of ASKER C hardness under a load of 500 gf. As a material for the urging member 31*a*, urethane is used but it is also possible to constitute the urging member 31*a* by using a rubber material such as epichlorohydrin rubber, NBR (nitrile rubber) or EPDM (ethylene-propylene-diene rubber). As the sheet member 32*a*, a resinous sheet having a volume resistivity of $10^6$ Ω·cm under application of 50 V is used. In this embodiment, as the sheet member 32*a*, a vinyl acetate sheet is used but sheets of polycarbonate (PC), PVDF, polyethylene terephthalate (PET), polyimide (PI), polyethylene (PE), polyamide (PA), and so on may also be used. With respect to the thickness of the sheet member 32*a*, the range of 30 μm to 500 μm is desirable. In the case where the sheet member having the thickness out of this range is used, the contact of by the repelling force in the bent state of the sheet member cannot be effected. In this embodiment, the sheet member 32*a* of 150 μm in thickness is used.

Here, an upstream side boundary position of the contact area between the photosensitive drum 1*a* and the intermediary transfer belt 13 is defined as A and a downstream side boundary position thereof is defined as D. That is, A is the boundary position between a non-contact area between the photosensitive drum 1*a* and the intermediary transfer belt 13 and the contact area on the upstream side. The non-contact area is an area in which the photosensitive drum 1*a* and the intermediary transfer belt 13 do not contact each other. The contact area is an area in which the photosensitive drum 1*a* and the intermediary transfer belt 13 contact each other. D is the boundary position between the contact area between the photosensitive drum 1*a* and the intermediary transfer belt 13 and the non-contact area on the downstream side. Further, an upstream side boundary position of the contact area between the intermediary transfer belt 13 and the sheet member 32*a* is defined as B. That is, B is the boundary position between a non-contact area in which the intermediary transfer belt 13 and the sheet member 32*a* do not contact each other and the contact area in which the intermediary transfer belt 13 and the sheet member 32*a* contact each other. Further, an upstream side boundary position of the contact area between the urging member 31*a* and the sheet member 32*a* is defined as C. That is, C is the boundary position between a non-contact area in which the sheet member 32*a* and the urging member do not contact each other and the contact area in which the sheet member 32*a* and the urging member 31*a* contact each other.

A measuring method of the above-described boundary positions A, B, C and D will be described below. With respect to the boundary positions A and D formed by the photosensitive drum 1*a* and the intermediary transfer belt 13, the belt drive is stopped and the photosensitive drum 1*a* is rotated in a state in which the toner image is present on the intermediary transfer belt 13. At this time, the toner image is formed only in the area in which the photosensitive drum 1*a* and the intermediary transfer belt 13 and therefore the measurement of the boundary positions A and D can be performed by measuring positions before and after the removal of the toner image.

Incidentally, when the measuring method is based on the same concept, e.g., a method in which the intermediary transfer belt 13 is marked (colored) with a vermilion ink pad, a Magic Marker or the like and is removal portion is measured may also be employed.

With respect to the boundary position B formed by the intermediary transfer belt 13 and the sheet member 32*a*, it is required to be considered that the boundary position B is a contact point between the flexible sheet member 32*a* and the intermediary transfer belt 13. In addition, influences of a frictional force by the rotational drive of the intermediary transfer belt 13 and the electrostatic attraction force by the voltage application to the sheet member 32*a* are required to be taken into consideration. Therefore, when the intermediary transfer belt 13 is rotated in a state in which the voltage is applied to the sheet member 32*a*, the boundary position B is measured on the basis of the contact area formed by the sheet member 32*a* and the intermediary transfer belt 13.

With respect to the boundary position C formed by the sheet member 32*a* and the urging member 31*a*, a contact point is measured through a cross section observation.

The boundary positions A, B, C and D obtained by the measurement described above is set so that when the boundary position A is 0 mm (reference position), toward the downstream side, the boundary position D is 3.0 mm, the boundary position B is 0.5 mm and the boundary position C is 0.7 mm. That is, a mutual relationship among the above-described boundary positions is the order of A, B, C and D from the upstream side. In other words, the contact area in which the photosensitive drum 1*a* and the intermediary transfer belt 13 contact each other is provided from the upstream side than the contact area in which the intermediary transfer belt 13 and the sheet member 32*a* contact each other. The contact area in which the intermediary transfer belt 13 and the sheet member 32*a* contact each other is provided from the upstream side than the contact area in which the sheet member 32*a* and the urging member 31*a* contact each other. The contact area in which the sheet member 32*a* and the urging member 31*a* contact each other is provided from the upstream side than the downstream side end in the contact area in which the photosensitive drum 1*a* and the intermediary transfer belt 13 contact each other. Further, a position of the downstream side end of the sheet member 32*a* is 5.5 mm when the boundary position A is the reference position. A position of the downstream side end of the urging member 31*a* is 4.7 mm when the boundary position A is the reference position. Incidentally, also with respect to the second to fourth stations, the same constitution as that of the first station is employed.

(Action)

Then, actions in this embodiment will be described in correspondence with the positional relationship among the boundary positions A, B, C and D. First, action (A to B) of disposition of the boundary position B on the downstream side of the boundary position A will be described. By employing this positional constitution, when the voltage is applied to the primary transfer device 10*a*, on the upstream side of the boundary position A, it is possible to suppress the influence of a transfer electric field generated between the photosensitive drum 1*a* and the primary transfer device 10*a*. The disposition of A on the upstream side of B means that an area, in which the strong electric field is exerted, on the downstream side of B is spaced from A and thus an increase in electric field between A and B is suppressed. As a result, it is possible to suppress transfer of a part of the toner image onto the intermediary transfer belt 13 by the action of the transfer electric field, on the toner image on the photosensitive drum 1*a*, in an upstream area of the contact area between the intermediary transfer belt 13 and the sheet member 32*a*. When the toner image is transferred on a position deviated from an original transfer position, there is a possibility that the toner image is partly decreased in density.

Next, in the case where the primary transfer device 10*a* is constituted by the urging member 31*a* and the sheet member 32*a*, action (B to C) of disposition of the boundary position C on the downstream side of the boundary position B will be described. By employing this positional constitution, in an area in which the intermediary transfer belt 13 and the sheet member 32*a* contact each other while bending the sheet member 32*a* in advance, the urging member 31*a* can urge the sheet member 32*a*. Particularly, the upstream side of the boundary position B is a portion at which distortion stress applied from the intermediary transfer belt 13 to the sheet member 32*a* concentrates. When the urging member 31*a* contacts the sheet member 32*a*, the sheet member 32*a* is deformed, so that the shape of the primary transfer nip becomes unstable. In some cases, there is a possibility that a phenomenon that the sheet member 32*a* is deformed by the urging member 31*a* and is separated from the intermediary transfer belt 13 occurs. Therefore, on the downstream side of the boundary position B deviated from the distortion stress concentration portion, the urging member 31*a* urges the sheet member 32*a* with a spacing from the boundary position B, whereby the sheet member 32*a* can be uniformly contacted to the intermediary transfer belt 13 with reliability with respect to the longitudinal direction. This is important to use the high-rigidity sheet member 32*a* in a further stable contact state in such a situation described above. As a result, it is possible to ensure a stable and uniform contact property between the sheet member 32*a* and the intermediary transfer belt 13 with respect to the longitudinal direction, so that it is possible to prevent a vertical stripe-like transfer defect resulting from contact non-uniformity in the transfer nip with respect to the longitudinal direction. That is, the intermediary transfer belt 13 and the sheet member 32*a* of the primary transfer device 10*a* are contacted to each other uniformly with respect to the longitudinal direction, so that the transfer can be effected satisfactorily.

Finally, action (C to D) of disposition of the boundary position D on the downstream side of the boundary position C will be described. By employing this positional constitution, the sheet member 32*a* contacts the intermediary transfer belt 13 in the contact area between the photosensitive drum 1*a* and the intermediary transfer belt 13 and therefore a spacing (gap) such as a stepped portion is not caused in the contact area between the sheet member 32*a* and the intermediary transfer belt 13. This is because the intermediary transfer belt 13 is supported by the photosensitive drum 1*a* when the intermediary transfer belt 13 is urged by the sheet member 32*a*. Therefore, it is possible to prevent an occurrence of a dot-like image void by electric discharge, at the spacing caused in the contact area between the sheet member 32*a* and the intermediary transfer belt 13, which charges the toner to the reverse polarity to prevent the toner image from transferring from the intermediary transfer belt 13.

Further, in this embodiment, the downstream ends of the sheet member 32*a* and the urging member 31*a* were located on the downstream side of the boundary position D. As a result, the sheet member 32*a* functions as an opposite electrode at a point where the sheet member 32*a* is separated from the photosensitive drum 1*a* and the intermediary transfer belt 13. Therefore, electric potential at the separation point is stabilized, so that the image defect due to separation electric discharge can be suppressed. In the downstream end position of the urging member 31*a*, the sheet member 32*a* is contacted to the intermediary transfer belt 13 with reliability, so that the above-described effect of the sheet member 32*a* as the opposite electrode is ensured. Incidentally, the actions in this embodiment is described with respect to the first station but the same actions as those in the case of the first station can also be achieved with respect to the second to fourth stations.

(Evaluation of Embodiment 1)

In order to check the effect of this embodiment, by using the image forming apparatus of 100 mm/sec in process speed, evaluation was performed with respect to the vertical stripe and transfer scattering at an initial stage and after sheet passing of 10,000 sheets in this embodiment and in Comparative Embodiments 1 to 3. Incidentally, a sheet passing durability test was conducted by using paper ("Xerox 4024", mfd. by Xerox Corp.; basis weight=75 g/m$^2$, and an image after passing of 10,000 sheets was evaluated. Constitutions of Comparative Embodiments 1 to 3 will be described with respect to (a) to (c) of FIG. 3, respectively, and evaluation results will be described with respect to FIG. 4.

Comparative Embodiment 1

In Comparative Embodiment 1, as shown in (a) of FIG. 3, the boundary position B and the boundary position C are set on the upstream side of the boundary position A. The positional relationship is B, C, A and D from the upstream side. The urging member 31*a* and the sheet member 32*a* used in Comparative Embodiment 1 are identical to those used in Embodiment 1. Next, the evaluation result will be described. In Comparative Embodiment 1, the boundary position B was located on the upstream side of the boundary position A and therefore the transfer electric field acted on the toner image on the photosensitive drum 1*a* before the contact area between the photosensitive drum 1*a* and the intermediary transfer belt 13, so that the transfer scattering occurred and thus the image quality was lowered.

Comparative Embodiment 2

In Comparative Embodiment 2, as shown in (b) of FIG. 3, the boundary position C is set on the downstream side of the boundary position A and is set on the upstream side of the boundary position B. The positional relationship is A, C, B and D from the upstream side. The urging member 31*a* and the sheet member 32*a* used in Comparative Embodiment 2 are identical to those used in Embodiment 1. Next, the evaluation result will be described. In Comparative Embodiment 3, the boundary position C was located on the upstream side of the boundary position B and therefore only an upstream side corner of the urging member 31*a* is a contact point (contact line) with the sheet member 32*a*, so that the primary transfer nip is constituted by relying on the repelling force of the bent sheet member 32*a*. That is, the pressure for contacting the sheet member 32*a* to the intermediary transfer belt 13 cannot be obtained from the urging member 31*a* but is obtained by only the repelling force for returning the bent sheet member 32*a* to the flat plate. Therefore, uniform pressure was not exerted from the urging member 31*a* to the sheet member 32*a* and for that reason, a uniform contact property between the sheet member 32*a* and the intermediary transfer belt 13 was unable to be ensured and thus the vertical stripe-like transfer defect occurred and the image quality was lowered.

Comparative Embodiment 3

In Comparative Embodiment 3, as shown in (c) of FIG. 3, the boundary position B and the boundary position C are set on the downstream side of the boundary position D. The positional relationship is A, D, B and C from the upstream side. The urging member 31*a* and the sheet member 32*a* used in Comparative Embodiment 3 are identical to those used in Embodiment 1. Next, the evaluation result will be described. In Comparative Embodiment 1, the boundary position B and the boundary position D were located on the downstream side of the boundary position D and therefore a nip area in the primary transfer nip was unable to be ensured. As a result, satisfactory transfer was unable to be effected considerably and thus the image quality was remarkably lowered.

In contrast to Comparative Embodiments described above, in the positional relationship in this embodiment, from the initial state and even after the passing of 10,000 sheets, it is possible to suppress the occurrences of the vertical stripe and the transfer scattering.

As described above, the characteristic feature of this embodiment is such that the primary transfer device 10*a* includes the urging member 31*a* and the sheet member 32*a* and a positional relationship between these constituent members is defined, and thus the urging member 31*a* which is the urging member for urging the sheet member 32*a* can urge the sheet member 32*a* with reliability. As a result, the primary transfer nip formed by the contact between the sheet member 32*a* and the intermediary transfer belt 13 can be made uniform with respect to the longitudinal direction, so that it is possible to prevent the vertical stripe-like transfer defect resulting from unstability of the primary transfer nip with respect to the longitudinal direction. Further, the boundary position B is disposed on the downstream side of the boundary position A, so that the influence of the transfer electric field can be suppressed. That is, it is possible to suppress a partial decrease in density of the toner image caused by the transfer of the toner image on the position deviated from the original transfer position.

Embodiment 2

In Embodiment 1 described above, the primary transfer device 10*a* was constituted by the sheet member 32*a* and the substantially rectangular parallelepiped-like urging member 31*a*. However, when the number of sheets subjected to passing is increased, with an increase in frictional force of the sheet member 32*a*, a force by which the sheet member 32*a* is drawn by the intermediary transfer belt 13 is increased, so that the urging member 31*a* is also drawn together with the sheet member 32*a* and thus is deviated toward the downstream side principally on the sheet member contact side thereof. Specifically, as shown in FIG. 5, by the electrostatic attraction force between the sheet member 32*a* and the intermediary transfer belt 13, the force by which the sheet member 32*a* is drawn in the downstream direction is generated. As a result, the boundary position B is moved to a downstream boundary position B'. With this movement, the urging member 31*a* is also deviated toward the downstream direction principally on the sheet member contact side thereof together with the sheet member 32*a*, so that the boundary position C is moved to a downstream boundary position C'. However, the influence on the urging member 31*a* is small, so that an amount of movement to the boundary position C' is smaller than that to the boundary position B'. For this reason, the boundary position B' is located on the downstream side of the boundary position C' (C' to B'). When these positions are kept as they are, as described in Comparative Embodiment 2 in Embodiment 1, the shape of the primary transfer nip becomes unstable to cause the transfer defect.

On the other hand, in this embodiment, as shown in FIG. 6, the shape of an urging member 41*a* used for the primary transfer device 10*a* is a trapezoidal configuration in cross section in which a contact surface (upper surface) at which the urging member 41*a* contacts the sheet member 32*a* is smaller than a surface (bottom surface) opposite from the contact surface. That is, an upstream side surface of the urging member 41*a* is an inclined surface which is directed toward the upstream side with an increasing distance from the contact surface with the sheet member 32*a*. Further, a downstream side surface of the urging member 41*a* is an incline surface which is directed toward the downstream side with an increasing distance from the contact surface with the sheet member 32*a*. Incidentally, the inclined surface is not limited to a flat surface but may also be a cured surface.

As a result, by the pressure from the opposite (bottom) surface of the urging member 41*a*, the deviation of the urging member 41*a* on the sheet member contact side in the downstream direction is suppressed. Therefore, even in the case where the frictional force of the sheet member 32*a* is increased by continuous image formation, the deviation of the urging member 41*a* on the sheet member contact side in the downstream direction (tilting of the urging member 41*a*) can be prevented, so that uniform primary transfer nip can be ensured with respect to the longitudinal direction. Further, as shown in FIG. 6, with respect to the relationship of the boundary positions in this embodiment, similarly as in Embodiment 1, the order of A, B, C and D from the upstream side is maintained and the setting thereof is also similar to that in Embodiment 1. Incidentally, the same constitution as that of the first station is employed also with respect to the second to fourth stations.

(Action)

In this embodiment, even when the force by which the sheet member 32*a* is drawn with an increasing print number of sheets, by the use of the urging member 41*a*, the pressure from the opposite (bottom) surface suppresses the deviation of the urging member 41*a* on the sheet member contact side. That is, the tilting of the urging member 41*a* toward the downstream direction can be prevented. Therefore, it is possible to effect stable transfer for a long term. Incidentally, the action in this embodiment is described with respect to the first station but the same action as that at the first station is also obtained at the second to fourth stations.

(Evaluation of Embodiment 2)

In this embodiment, similarly as in Embodiment 1, the evaluation of the vertical stripe and the transfer scattering at the initial stage and after passing of 10,000 sheets and 50,000 sheets was made. The result is shown in FIG. 7.

Embodiment 1

In this embodiment, after passing of 50,000 sheets, the sheet member 32*a* is drawn in the downstream direction by the electrostatic attraction force between the sheet member 32*a* and the intermediary transfer belt 13 to cause the tilting of the urging member 31*a*, so that uniform primary transfer nip cannot be ensured with respect to the longitudinal direction. As a result, the vertical stripe-like transfer defect occurred, so that the image quality was lowered.

Embodiment 2

On the other hand, in Embodiment 2, the shape of the urging member 41*a* is the trapezoidal configuration in cross section and therefore the tilting of the urging member 41*a* do not occur. As a result, even when the passing of 50,000 sheets was effected, the uniform primary transfer nip was able to be ensured with respect to the longitudinal direction, so that both of the vertical stripe and the transfer scattering did not occur.

Incidentally, on the basis of a concept similar to that in Embodiment 2, as shown in FIG. 8, a supporting member 33*a* for supporting a rectangular parallelepiped-shape urging member 31*a* to prevent the tilting of the urging member 31*a* toward the downstream direction may be further provided. Also by this, an effected similar to that in Embodiment 2 is obtained. Incidentally, the sheet member 33*a* is more effective when it supports the urging member 31*a* at a position closer to the sheet member side. Further, the urging member supported by the supporting member 33*a* may also be the urging member 41*a* as in Embodiment 2, thus being not limited to the urging member 31*a* in shape.

Other Embodiments

In Embodiments 1 and 2 described above, the image forming apparatus of the intermediary transfer type was applied and described. However, the present invention is similarly applicable to also a so-called image forming apparatus of a direct transfer type in which a conveyer belt (belt) for carrying and conveying the transfer material onto which the toner image carried on the photosensitive drum is to be transferred as shown in FIG. 9 is provided in place of the intermediary transfer belt. The conveyer belt is an endless shape and is rotatable. Further, the present invention may also be applied to an image forming apparatus for a single color, i.e., a so-called monochromatic image forming apparatus.

In the image forming apparatus of the direct transfer type shown in FIG. 9, a color image is formed by directly and successively transferring toner images carried on the respective photosensitive drums 1*a* to 1*d* onto the transfer material P during conveyance to the respective stations by the conveyer belt. The contact areas between a conveyer belt 110 and the photosensitive drums 1*a* to 1*d* are an area in which the conveyer belt 110 opposes the photosensitive drums 1*a* to 1*d* through the transfer material P. That is, the transfer material P is to be interposed between the conveyer belt 110 and each of the photosensitive drums 1*a* to 1*d*. In the image forming apparatus of the direct transfer type, the same constitution as that described above except that the photosensitive drum 1*a* and the conveyer belt 110 oppose each other through the transfer material P as shown in FIG. 10 is employed. The characteristic feature of the constitution will be summarized below. Incidentally, in the following, the first station will be described representatively but the same constitution as that of the first station is employed also with respect to the second to fourth station.

The urging member 31*a* contacts the sheet member 32*a*, at a surface of the sheet member 32*a* opposite to the contact surface with the conveyer belt 110, in the contact area in which the sheet member 32*a* contacts the conveyer belt 110. Further, the contact area in which the conveyer belt 110 and the sheet member 32*a* contact each other is provided from the upstream side of the contact area in which the sheet member 32*a* and the urging member 31*a* contact each other, with respect to the rotational direction of the conveyer belt 110. That is, the boundary position C is disposed on the downstream side of the boundary position B (B to C).

The contact area in which the photosensitive drum 1*a* contact the transfer material P contacting the conveyer belt 110 is provided from the upstream side of the contact area in which the conveyer belt 110 and the sheet member 32*a* contact each other, with respect to the rotational direction of the conveyer belt 110. That is, the boundary position B is disposed on the downstream side of the boundary position A (A to B).

The contact area in which the sheet member 32*a* and the urging member 31*a* contact each other is provided from the upstream side of the downstream side end of the contact area in which the photosensitive drum 1*a* contacts the transfer material P contacting the conveyer belt 110, with respect to the rotational direction of the conveyer belt 110. That is, the boundary position D is disposed on the downstream side of the boundary position C (C to D).

The sheet member 32*a* has flexibility and is fixed at its upstream side end (one end) spaced from the conveyer belt with respect to the rotational direction of the conveyer belt 110, and is contactable to the conveyer belt 110 by the repelling force in the state in which it is bent from the fixed end (one end) to the other end on a free end side.

Further, the upstream side surface of the urging member 31*a* with respect to the rotational direction of the conveyer belt 110 may preferably be the inclined surface which is directed toward an upper stream side with respect to the rotational direction of the conveyer belt 110 with an increasing distance from the contact surface with the sheet member 32*a*. Further, the downstream side surface of the urging member 31*a* with respect to the rotational direction of the conveyer belt 110 may preferably be the inclined surface which is directed toward a lower stream side with respect to the rotational direction of the conveyer belt 110 with an increasing distance from the contact surface with the sheet member 32*a*.

The primary transfer device 10*a* may include a supporting member for supporting the urging member 31*a* from the downstream side with respect to the rotational direction of the conveyer belt 110.

Also in the image forming apparatus of the direct transfer type as described above, the action and effect similar to those in Embodiments 1 and 2 described above can be achieved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 018603/2010 filed Jan. 29, 2010, which is hereby incorporated by reference.

What is claimed is:

1. An image forming apparatus comprising:

an image bearing member for bearing a toner image;

an endless rotatable intermediary transfer belt onto which the toner image is to be transferred from said image bearing member;

a transfer device disposed at a position in which said transfer device opposes said image bearing member through said intermediary transfer belt, said transfer device including a sheet member surface-contacted to an inner surface of said intermediary transfer belt and including an urging member for urging the sheet member toward said intermediary transfer belt; and a primary transfer voltage source for applying a voltage to the sheet member, wherein with respect a rotational direction of said intermediary transfer belt, an upstream end portion of a contact area formed between said intermediary transfer belt and the sheet member and an upstream end portion of a contact area formed between the sheet member and the urging member are within a range of a contact area formed between said intermediary transfer belt and said image bearing member, and wherein the upstream end portion of the contact area formed between said intermediary transfer belt and the sheet member is located upstream of the upstream end portion of the contact area formed between the sheet member and the urging member.

2. An image forming apparatus according to claim 1, wherein the sheet member has flexibility and is fixed at an end on an upstream side thereof with respect to the rotational direction of said intermediary transfer belt, and wherein the sheet member is contacted to said intermediary transfer belt in a state in which the sheet member is bent from the fixed upstream side end toward the other end on a free end side thereof.

3. An image forming apparatus according to claim 1, wherein with respect to the rotational direction of said intermediary transfer belt, a downstream end portion of the contact area between the sheet member and said intermediary transfer belt is located downstream of a downstream end portion of the contact area between said intermediary transfer belt and said image bearing member.

4. An image forming apparatus according to claim 1, wherein with respect to the rotational direction of said intermediary transfer belt, a downstream end portion of the contact area between the sheet member and the urging member is located downstream of a downstream end portion of the contact area between said intermediary transfer belt and said image bearing member.

5. An image forming apparatus according to claim 1, wherein with respect to the rotational direction of said intermediary transfer belt, a downstream end portion of the contact area between the sheet member and said intermediary transfer belt is located downstream of a downstream end portion of the sheet member and the urging member.

6. An image forming apparatus according to claim 1, wherein with respect to the rotational direction of said intermediary transfer belt, an upstream side end surface of the urging member is an inclined surface which is directed toward an upstream side with respect to the rotational direction of said intermediary transfer belt with an increasing distance from the contact area between the sheet member and the urging member, and wherein with respect to the rotational direction of said intermediary transfer belt, a downstream side end surface of the urging member is an inclined surface which is directed toward a downstream side with respect to the rotational direction of said intermediary transfer belt with an increasing distance from the contact area between the sheet member and the urging member.

7. An image forming apparatus according to claim 1, wherein said transfer device further includes a supporting member for supporting the urging member from the downstream side with respect to the rotational direction of said intermediary transfer belt.

8. An image forming apparatus comprising:

an image bearing member for bearing a toner image;

an endless rotatable conveyer belt for carrying and conveying a transfer material onto which the toner image is to be transferred from said image bearing member;

a transfer device disposed at a position in which said transfer device opposes said image bearing member through said conveyer belt, said transfer device including a sheet member surface-contacted to an inner surface of said conveyer belt and including an urging member for urging the sheet member toward said conveyer belt; and a primary transfer voltage source for applying a voltage to the sheet member, wherein with respect a rotational direction of said conveyer belt, an upstream end portion of a contact area formed between said conveyer belt and the sheet member and an upstream end portion of a contact area formed between the sheet member and the urging member are within a range of a contact area formed between said conveyer belt and said image bearing member, and wherein the upstream end portion of the contact area formed between said conveyer belt and the sheet member is located upstream of the upstream end portion of the contact area formed between the sheet member and the urging member.

9. An image forming apparatus according to claim 8, wherein the sheet member has flexibility and is fixed at an end on an upstream side thereof with respect to the rotational direction of the conveyer belt, and wherein the sheet member is contacted to said conveyer belt in a state in which the sheet member is bent from the fixed upstream side end toward the other end on a free end side thereof.

10. An image forming apparatus according to claim 8, wherein with respect to the rotational direction of said conveyer belt, a downstream end portion of the contact area between the sheet member and said conveyer belt is located downstream of a downstream end portion of the contact area between said conveyer belt and said image bearing member.

11. An image forming apparatus according to claim 8, wherein with respect to the rotational direction of said conveyer belt, a downstream end portion of the contact area between the sheet member and the urging member is located downstream of a downstream end portion of the contact area between said conveyer belt and said image bearing member.

12. An image forming apparatus according to claim 8, wherein with respect to the rotational direction of said conveyer belt, a downstream end portion of the contact area between the sheet member and said conveyer belt is located downstream of a downstream end portion of the sheet member and the urging member.

13. An image forming apparatus according to claim 8, wherein with respect to the rotational direction of said conveyer belt, an upstream side end surface of the urging member is an inclined surface which is directed toward an upstream side with respect to the rotational direction of said conveyer belt with an increasing distance from the contact area between the sheet member and the urging member, and wherein with respect to the rotational direction of said conveyer belt, a downstream side end surface of the urging member is an inclined surface which is directed toward a downstream side with respect to the rotational direction of said conveyer belt with an increasing distance from the contact area between the sheet member and the urging member.

14. An image forming apparatus according to claim 8, wherein said transfer device further includes a supporting member for supporting the urging member from the downstream side with respect to the rotational direction of said conveyer belt.

* * * * *